US005911185A

United States Patent [19]

Pantusco

[11] Patent Number: 5,911,185

[45] Date of Patent: Jun. 15, 1999

[54] HEM FOLDING ATTACHMENT

[75] Inventor: Frank Sebastian Pantusco, Atlanta, Ga.

[73] Assignee: Georgia Attachment Company, Inc., Norcross, Ga.

[21] Appl. No.: 08/935,025

[22] Filed: Sep. 22, 1997

[51] Int. Cl.[6] ..... D05B 35/02

[52] U.S. Cl. ..... 112/141; 112/DIG. 2

[58] Field of Search ..... 112/141, 143, 112/147, 142, 153, 136, DIG. 2, DIG. 3

[56] References Cited

U.S. PATENT DOCUMENTS

| | | | |
|---|---|---|---|
| 3,595,187 | 7/1971 | Gray | 112/141 |
| 3,886,877 | 6/1975 | Akaishi et al. | 112/DIG. 2 |
| 4,095,537 | 6/1978 | Silverman et al. | 112/141 |
| 5,373,796 | 12/1994 | Bottoms et al. | 112/262 |
| 5,441,004 | 8/1995 | Bottoms et al. | 112/475 |

*Primary Examiner*—Peter Nerbun
*Attorney, Agent, or Firm*—Bernstein & Associates, P.C.

[57] ABSTRACT

A hem folding attachment (23) or former having a support plate (26), an underlay plate (29), a set of air nozzles (32) or air jets, and a vacuum chamber (35) having a reduced pressure area defined therein. The support plate (26) or tongue is adjustably mounted above the vacuum chamber (35) and the front edge (38) of the support plate (26) extends beyond and overhangs the edge of the vacuum chamber (35). An edge of a piece of material is folded around the front edge (38) of the support plate (26) and extends back toward the vacuum chamber (35). The vacuum chamber has a guiding surface (41) with a set of air intake orifices (47) defined therein for aligning the edge of the material. The orifices (47) receive air from a set of nozzles (32). The nozzles (32) and the vacuum chamber (35) assist the raw edge of the piece of material in being folded back underneath the rest of the material. An underlay plate (29) also guides the edge of the material toward the vacuum chamber (35).

21 Claims, 5 Drawing Sheets

HEM FOLDING ATTACHMENT

FIELD OF THE INVENTION

The present invention relates to devices for folding sheet materials, and more particularly to a hem folder attachment for a sewing machine.

BACKGROUND

When a hem is formed at the edge of a piece of a garment such as a sleeve, the raw edge of the material is typically folded underneath the remainder of the material and then sewn with a coverstitch. If the folded edge does not conform to a straight line along the length of the piece as it travels through the sewing machine, the coverstitch will not cover all of the raw edge of the folded under portion of the material. If the raw edge extends for any significant distance beyond the stitching, the sewn product may be rejected by the buyer for poor quality.

The raw edge of sleeves can deviate from the optimally straight fold line for several reasons; e.g., the goods received for sewing were simply not cut on a straight line. With manual pattern making and cutting of goods there is always the possibility of error between the marking operation and the cutting. In highly automated environments with patterns that are produced by CAD systems and that are automatically fed to computer controlled cutting machines, there is a much greater degree of accuracy but the attendant costs make this technology unavailable to vast numbers of garment manufacturers.

The other reasons for deviation from the optimal fold line relate to the method of making the fold. The least effective way of making the fold is to have the sewing machine operator manually fold the piece prior to sewing. This method leads to second quality goods and is usually too slow to be commercially feasible. Another way to make the fold is through a former. Typically, formers have plates which form a channel which progressively inverts the edge of the material as the material is moved through the channel towards the sewing machine. To obtain a uniform hem these formers rely on the operator's skill and close attention in directing the cloth through the former and in maintaining proper alignment of the material throughout sewing. Formers have also been provided which use jets of air to urge materials into the channels for folding. A problem with air jets is that the air from the jets can cause the raw edge to flutter which can cause the edge to lose its alignment with the fold line.

In order to reduce the problems with sewing machine operator error and cutting inaccuracies, conveying systems with edge trimmers have been used. The conveyor systems include conveyors, edge trimmers, formers, and sometimes air jets. In the typical conveyor operation, the sleeve goes through an edge trimming knife and then is immediately captured by a conveyor to maintain the straight edge cut by the knife. The piece is then conveyed by positive traction through a former which creates the fold for sewing. After the piece leaves the former it is fed into the feed dog of the sewing machine. In order to allow for edge trimming, some manufacturers that use the conveying systems require that the pieces be cut with up to a quarter of an inch of extra material at the edge. In the conveying systems, the piece of material is fixed into a specific orientation as it leaves the edge trimmer, and the conveyor does not allow the piece of material to move in any direction other than in a straight line to the sewing head. The formers typically extend to a point very close to the sewing machine in an attempt to maintain control of the edge and the fold for as long as possible before the piece of material engages with the sewing machine.

The conveying systems have not been altogether satisfactory for certain garment manufacturers because of the equipment cost, the added material costs associated with edge trimming and the time and expense of training the operators and service technicians on how to use and service the machines.

What is needed is a hem folding attachment that solves the problems associated with hemming imprecisely cut materials and that solves the problems associated with the manual and automatic hemming methods described above.

SUMMARY OF THE INVENTION

The present invention provides a device for folding the raw edge of a sheet of material back underneath the material and maintaining the alignment of the material along a fold line while the resulting hem is being sewn.

In a preferred embodiment, the present invention provides a support plate having an upper and a lower surface. The upper and lower surface merge along an elongated front edge. The support plate is mounted above and overhangs a vacuum chamber. The vacuum chamber has a guiding surface defined on the side of the chamber facing the front of the support plate. The goal of the folding operation is to fold the raw edge of a piece of material over the elongated front edge and to extend the raw edge underneath the support plate until it reaches the guiding surface. The guiding surface has at least one air intake orifice therethrough for drawing a vacuum. At least one air nozzle is disposed in spaced apart relation with the guiding surface such that a stream of air from the nozzle is directed toward the air intake orifice. The airstream from the air nozzle urges the material toward the guiding surface. An underlay surface also aids the material in making the fold back underneath the lower surface by extending beneath at least a portion of the lower surface of the support plate.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
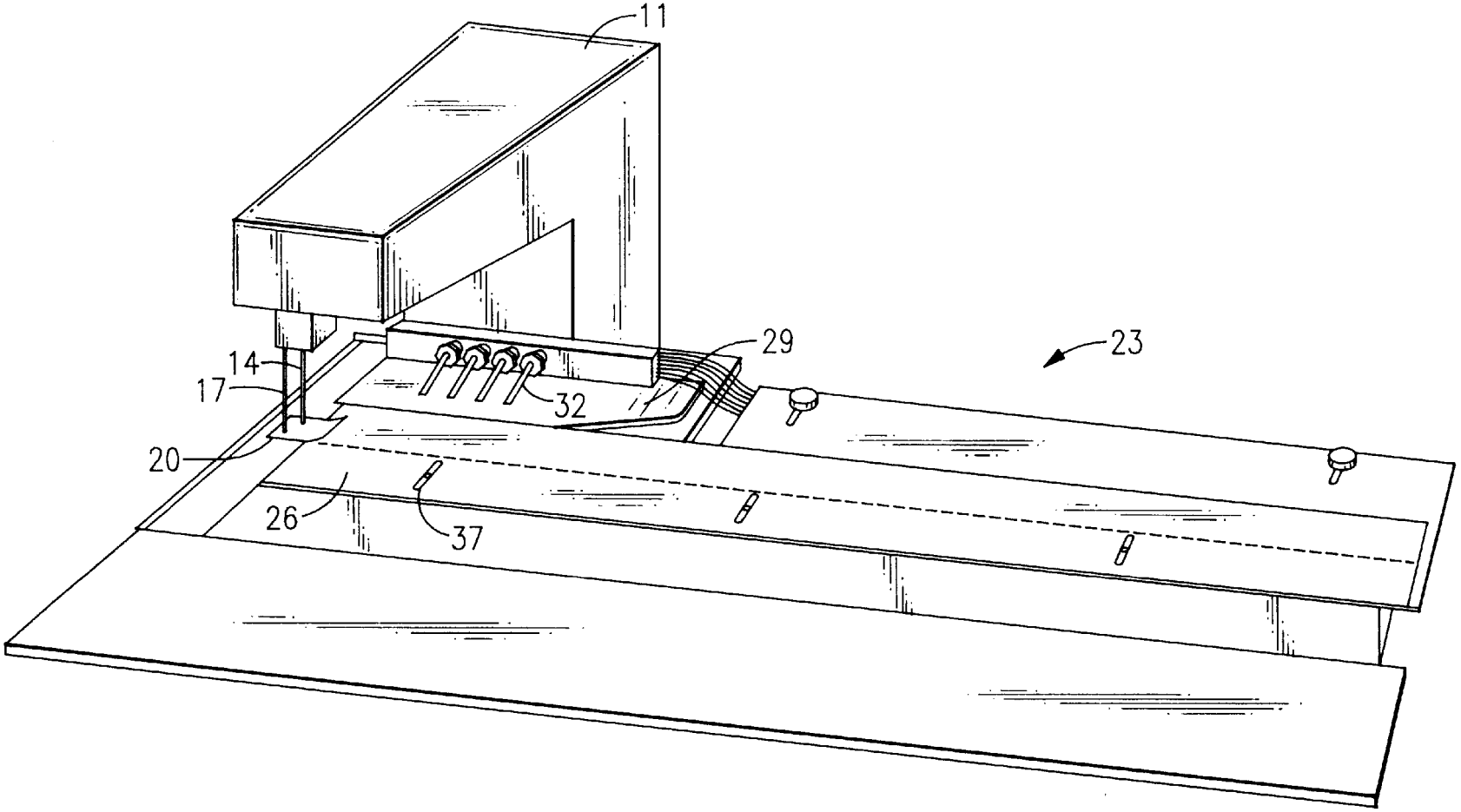
FIG. 1 is a perspective view of a conventional sewing machine to which a hem folding attachment embodying principles of the invention is mounted.

FIG. 1 shows a standard coverstitch sewing machine 11 having an inside reciprocating needle 14, an outside reciprocating needle 17, and a presser foot 20. The hem folding attachment 23 of the present invention extends into close proximity with the presser foot 20. The attachment 23 is used to fold the raw edge 24 of a piece of material 25 (shown in FIG. 3), such as a part cut for a sleeve, back underneath the material 25 and to maintain the fold until the material 25 is sewn. The raw edge 24 is sewn to the material 25 by the coverstitch sewing machine 11 which uses the reciprocating needles 14 and 17 to form a wide stitch pattern for covering the raw edge 24.

Figure 2:
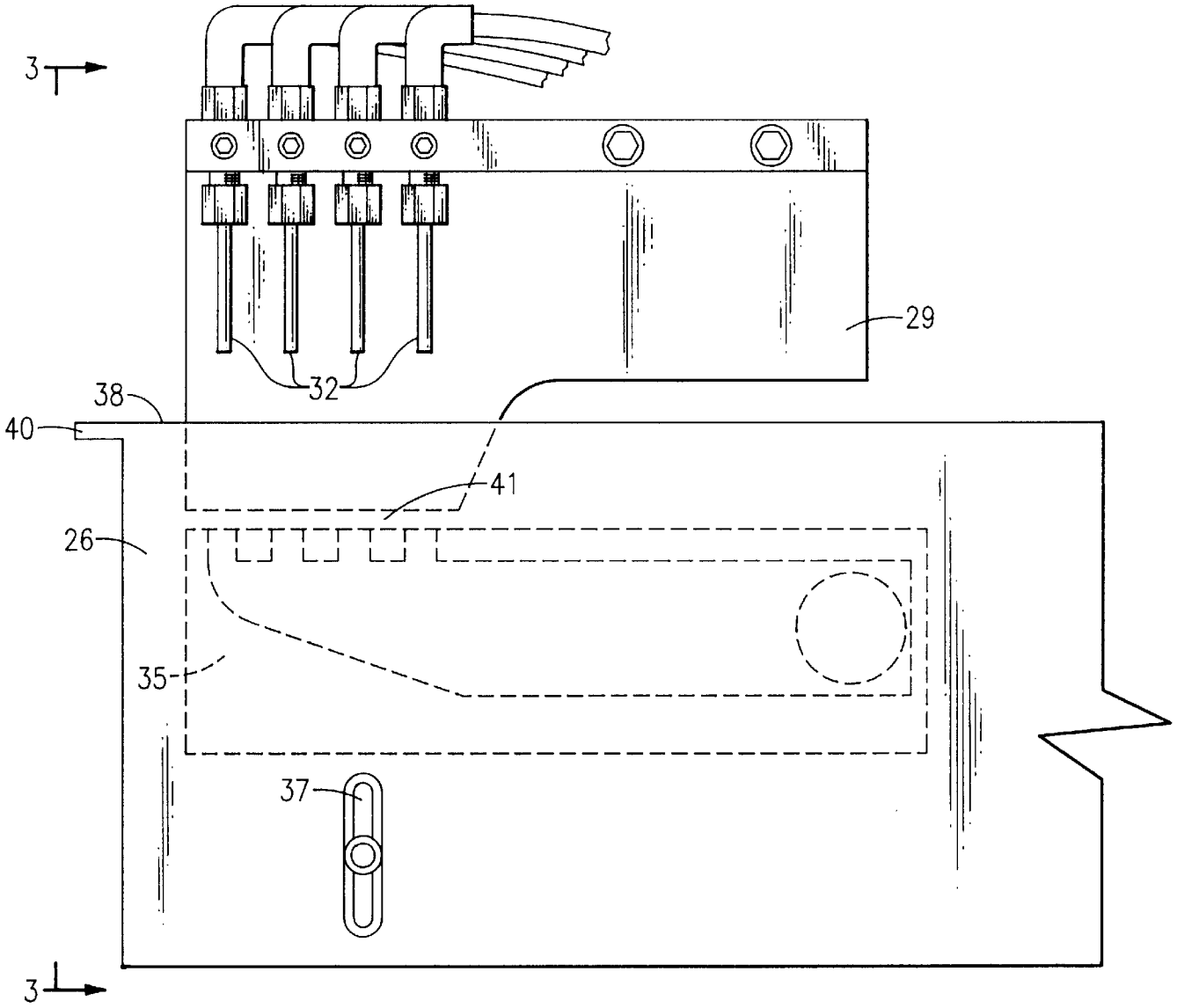
FIG. 2 is a plan view of the attachment of the present invention.
Figure 5:
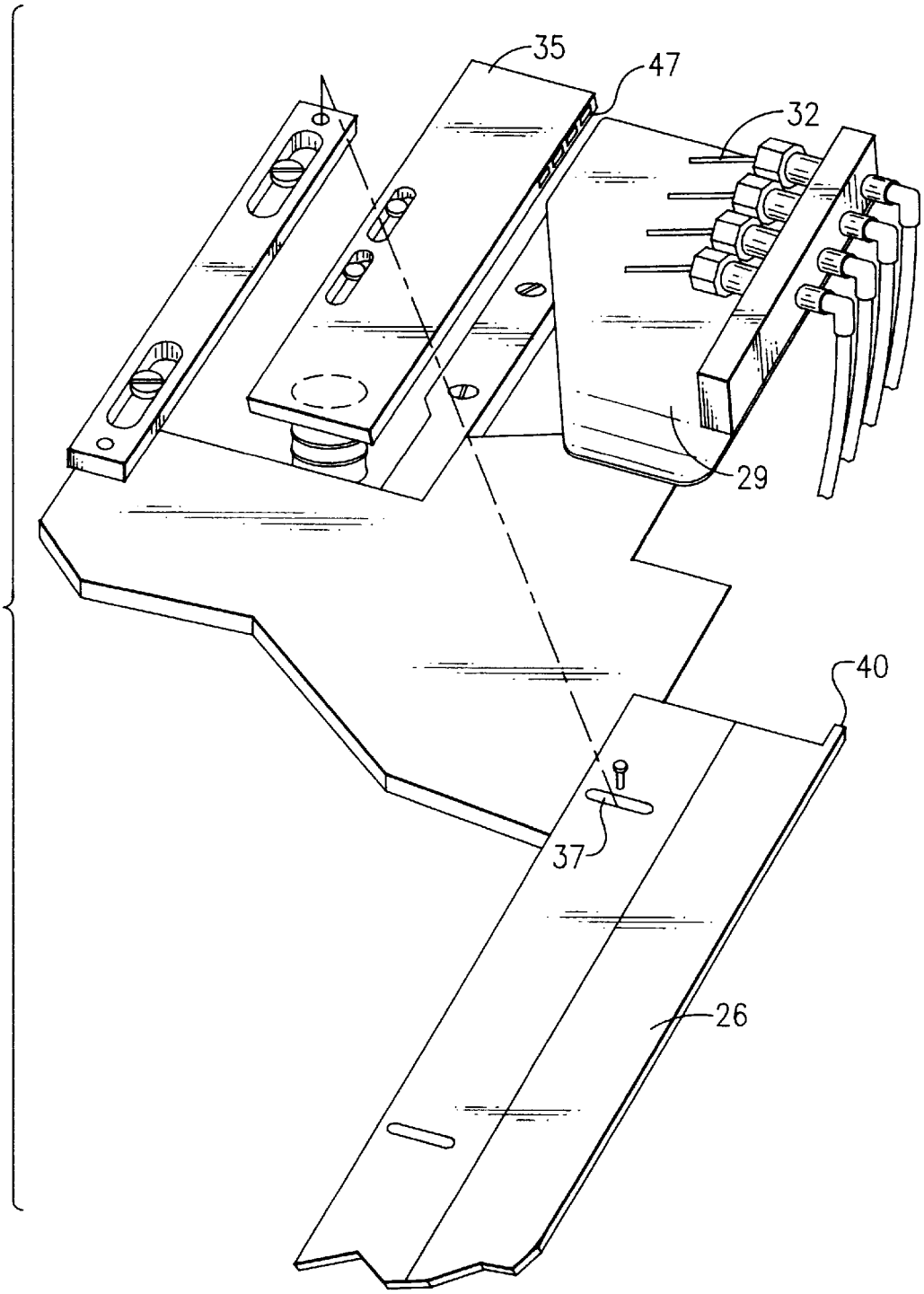
FIG. 5 is a partially exploded perspective view of the attachment.

Referring to FIG. 2 and FIG. 5, the hem folding attachment 23 is comprised of four main elements including a support plate 26, an underlay plate 29, a set of air nozzles 32, and a vacuum chamber 35. "Vacuum chamber" is defined as a chamber capable of having a pressure less than the surrounding atmosphere. The support plate mounts above the top of the vacuum chamber 35 through a set of slots 37 in the support plate 26. The slots 37 allow for adjustment of the mounting position of the support plate 26 relative to the vacuum chamber 35. For wider hems the overhang of the support plate 26 relative to the vacuum chamber 35 is increased, and for narrower hems it is decreased. An elongated member 40 extends off of the support plate 26 toward the sewing machine 11 and adjacent to the presser foot 20.

The underlay plate 29 extends below the support plate 26 and is preferably adjustable between no gap and up to approximately 3/32 of an inch gap between the end of the plate 29 and a guiding surface 41. The underlay plate 29 preferably extends parallel to the guiding surface 41 and then extends away from the guiding surface 41 either along a curve or at a relatively sharp angle.

The air nozzles 32 are mounted above the underlay plate 29 and direct a stream of air toward the guiding surface 41. The nozzles 32 are standard directed air nozzles or air jets such as those having a sixteenth of an inch diameter output. It is to be understood that a greater or lesser number of nozzles could be used depending on the material 25. The nozzles are commercially available from numerous sources including Pneumadyne in Plymouth, Minn. In order to protect the nozzles 32 from dirt and other objects, they can be covered by another flat plate (not shown).

Figure 3:
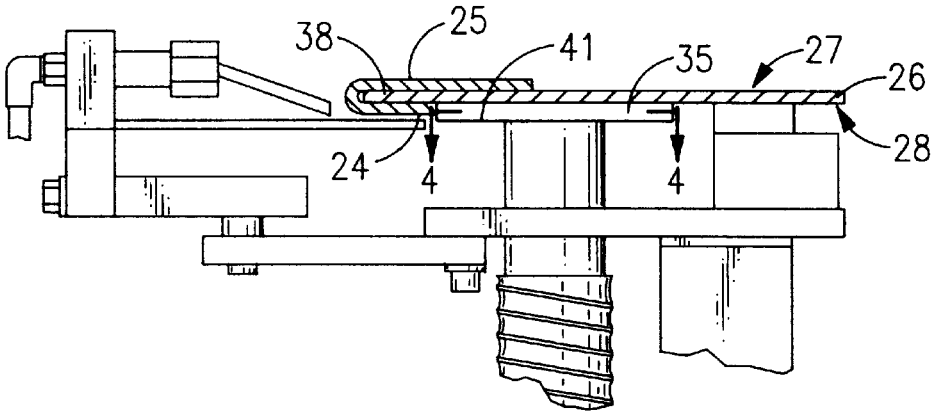
FIG. 3 is a front elevation view of the attachment taken along line 3—3.

Referring to FIG. 3, the support plate 26 is a thin metal plate formed such that the upper surface 27 and the lower surface 28 merge to form a front edge 38. The support plate 26 mounts above the top of the vacuum chamber 35 such that support plate 26 extends beyond the vacuum chamber 35.

The side of the vacuum chamber 35 forms the guiding surface 41 for guiding the raw edge 24 of the material 25. The guiding surface 41 has a set of orifices 47 (best shown in FIG. 4) that allows air from the air nozzles 32 and from the surrounding area to enter the vacuum chamber 35. In a preferred embodiment, the orifices 47 extend for approximately two and one-quarter inches and each orifice is preferably between one-eighth and a quarter of an inch wide and about one to two sixteenths in height. The orifices 47 have one-eighth to three-eighths of an inch between them. The number and size of the orifices may be varied depending on the number of nozzles and the properties of the particular materials.

Figure 4:
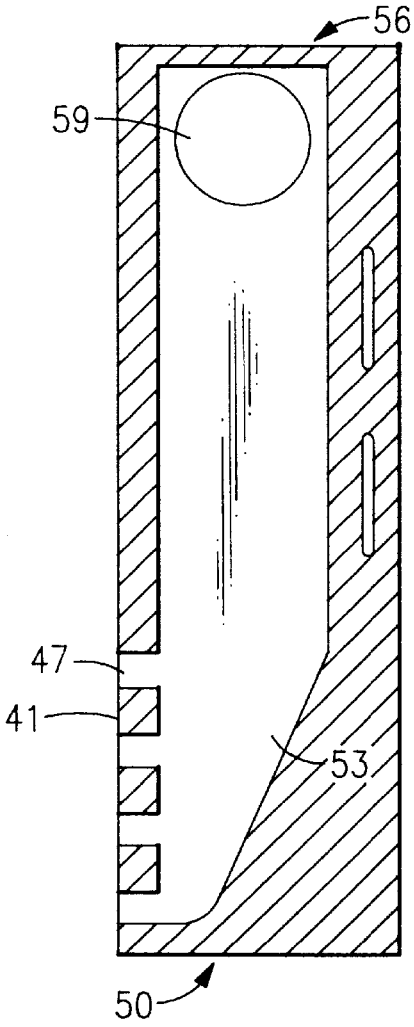
FIG. 4 is a cutaway plan view of the vacuum chamber taken along line 4—4.

As shown in FIG. 4, the vacuum chamber 35 can be approximately seven inches long and two inches wide. The intake end 50 of the vacuum chamber 35 has a curved section 53 that extends toward the outlet end 56. For some applications, the curved section 53 can be eliminated whereby the vacuum area forms a rectangle with rounded corners. An air outlet opening 59 is positioned near the outlet end 56. The outlet opening 59 is preferably a one inch diameter round opening. In order to create a smooth flow of air through the vacuum chamber 35, the cross sectional area of the chamber 35 at the outlet end 56 and the cross sectional area of the outlet opening 59 is equal to or greater than the cross sectional area of the orifices 47.

Figure 6:
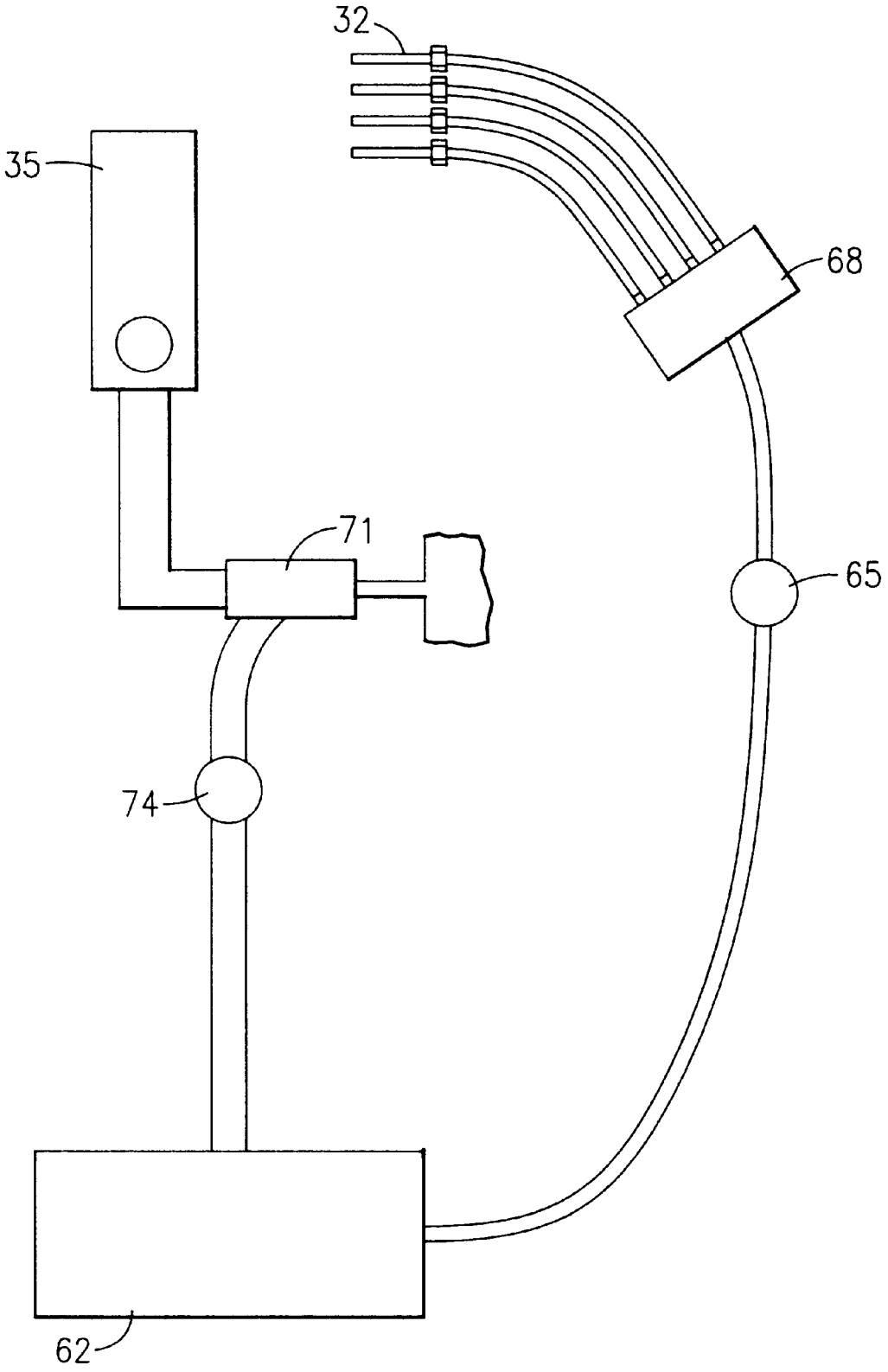
FIG. 6 is a schematic diagram of the present invention.

Referring to FIG. 6, the vacuum and the air nozzles 32 are preferably both operated off of the same compressor 62 with a line pressure of 60 to 80 psi. The air nozzles 32 can have 5/32 of an inch ID tubing for input of the compressed air and the nozzles 32 typically each have equal output. For the nozzles 32, a manual flow control 65 is positioned upstream from a manifold 68 that can take a single quarter inch ID line from the compressor and split it into four 5/32" lines for input to the nozzles 32. It is to be understood that the measurements used in describing the preferred embodiment are exemplative only and not critical unless so stated.

A vacuum is drawn on the vacuum chamber 35 by a standard venturi type system 71 which is commercially available from several sources including one sold as a waste system vacuum available from Templex in High Point, N.C. The input to the vacuum is compressed air at 60–80 psi through quarter inch I.D. tubing. The vacuum is equipped with a manual flow control 74. The flow controls 65 and 74 for both the input to the air nozzle and the input to the vacuum venturi are preferably manually adjustable, needle valves.

The amount of air needed for the air nozzles 32 and the vacuum system 71 varies depending on the characteristics of the material 25 being sewn. For lighter weight goods less air and vacuum is required. As a general rule, the vacuum chamber 35 has to induce an airflow equal to or greater than the airflow generated by the air nozzles 32 because air backing up in the system will create a disturbance around the folded edge 24. It is preferable to have a greater airflow induced by the vacuum because the vacuum chamber 35 should draw in air from the nozzles 32 and from the area between the underlay plate 29 and the guiding surface 41. The vacuum and air should be adjusted for the particular material 25 so that the material 25 folds over the front edge 38 of the support plate 26 and so that the edge 24 of the material 25 is directed to the guiding surface 41 by the combination of air and vacuum. When the amount of vacuum and air is adjusted properly, the material 25 will adhere to the lower surface 36 without fluttering. The amount of airflow through the system for most materials is approximately 4 CFM, but this number varies for other materials. Heavier materials will require more CFM, and lightweight material such as some materials used for lingerie can require as little as 1.5 CFM.

In operation, the attachment 23 is attached to a sewing platform such that the elongated member 40 is positioned to the inside of the presser foot 20 near the inside reciprocating needle 14. The piece of material 25 is placed on the upper surface 27 and can be introduced into the folding area in several ways. First, the piece of material 25 can be slid along the upper surface 27 toward the sewing machine 11 with the edge 24 of the material 25 overhanging the front edge 38. When the material 25 reaches the underlay plate 29, the angle between the underlay plate 29 and the support plate 26 initiates the folding of the edge 24 of the material 25 underneath the lower surface 28. After the underlay plate has started the fold, the air nozzles 32 and the vacuum chamber 35 act on the material to bring it to the guiding surface 41. Another way to introduce the material 25 into the folding area is to move it straight towards the air nozzles 32 and tuck the edge 24 of the material 25 over the front edge 38 far enough for the combination of the air nozzles 32 and the vacuum chamber 35 to act upon the edge 24 to make it fold underneath the support plate 26 and move to the guiding surface 41. Also, the material 25 can be conveyed on top of moving belts (not shown).

In either event, once the edge 24 of the material 25 reaches a certain point underneath the lower surface 36, the combination of the air from the nozzles and the vacuum from the vacuum chamber 35 automatically pulls the edge 24 to the proper position at the guiding surface 41 and keeps it there while the material 25 is moved into and through the sewing machine 11.

Once the raw edge 24 is brought to the end 62 of the guiding surface 41, the operator only has to move the piece of material 25 a fraction of an inch until the feed dog of the sewing machine 11 takes over and pulls the piece through the machine 11.

In an alternate embodiment, the present invention can be used to form an upturned hem. By inverting the vacuum chamber 35, the nozzles 32, the support plate 26, and the underlay plate 29; the same invention could be used to form an upturned fold for an upturned hem.

The invention offers several important advantages including the ability to accurately and inexpensively maintain hem fold alignment prior to sewing. The cost advantage results from eliminating the requirement of an edge trim operation at the sewing station. The advantage with respect to the accuracy of the hem fold results in part because it eliminates the flutter associated with typical air jets.

Further, by having a vacuum chamber 35 with a guiding surface 41 that extends for only a portion of the piece of cloth and by not locking down the material with a conveyor, the folder is able to continuously compensate for cutting mistakes on an incremental basis. The increment for adjustment is approximately equal to the width of the guiding surface 41. By being able to adjust on this basis, the folder can follow and adjust to the contour of the edge in smaller increments rather than trying to square up the entire length of the edge.

The attachment 23 is flexible in that it can be used on a sewing machine 11 that is operated on either a continuous or an intermittent basis. For continuous operation a sewing machine capable of chaining off or a puller for chaining off the stitching is required. To operate without a puller or automatically chaining machine, the system can be run on an intermittent basis. In order to do so, an electric eye and a motor control can be used to start and stop the sewing machine 11 during the sewing of each sleeve. If the sewing machine 11 is allowed to run without a puller and it runs out of material to sew, the thread will break.

Accordingly, the attachment 23 offers a low cost, low maintenance, operator friendly solution to hem folding for imprecisely cut goods. The savings associated with this attachment 23 will be realized from lower capital equipment costs, lower training costs, and lower raw material costs.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

I claim:

1. A sewing machine attachment subassembly for folding an edge of a piece of material back underneath the material to form a hem, comprising:

a) a support plate having an upper surface and a lower surface, the upper surface and lower surface merging along an elongated front edge; and b) a vacuum chamber mounted beneath the lower surface and having a guiding surface having at least one air intake orifice therethrough such that the guiding surface provides an abutment preventing the raw edge of the material from being drawn into the vacuum chamber, the guiding surface defines a wall of the vacuum chamber, and the vacuum chamber induces the edge of the material into alignment and abutment with the guiding surface.

2. A sewing machine attachment for folding an edge of material, comprising:

a) a support plate having an upper surface and a lower surface, the upper surface and lower surface merging along an elongated front edge;

b) a vacuum chamber mounted beneath the lower surface and having a guiding surface having at least one air intake orifice therethrough such that the guiding surface provides an abutment preventing the raw edge of the material from being drawn into the vacuum chamber, the guiding surface defines a wall of the vacuum chamber, the guiding surface extends along only a portion of the piece of material, and the vacuum chamber induces the edge of the material into alignment and abutment with the guiding surface;

c) at least one air nozzle disposed in spaced apart relation to the air intake orifice such that a stream of air is directed from the nozzle toward the orifice such that the stream of air induces the edge of the material into alignment and abutment with the guiding surface; and d) an underlay surface extending beneath at least a portion of the lower surface.

3. The sewing machine of claim 2, wherein the support plate is adjustably mounted above the vacuum chamber such that the distance between the guiding surface and the front edge is variable, while allowing unimpeded access of the edge of the material to the guiding surface.

4. The sewing machine attachment of claim 3, further comprising an elongated member extending from and substantially in alignment with the front edge of the support plate.

5. The sewing machine attachment of claim 2, further comprising an elongated member extending from and substantially in alignment with the front edge of the support plate.

6. The sewing machine attachment of claim 2, wherein an edge of the underlay surface extends away from the guiding surface such that the edge of the material is tucked under the lower surface by the edge of the underlay surface when the material overhangs and travels along the front edge.

7. A sewing machine attachment for folding an edge of material, comprising:

a) a support plate having an upper surface and a lower surface, the upper surface and lower surface merging along an elongated front edge;

b) a vacuum chamber mounted beneath the lower surface and having a guiding surface having at least one air intake orifice therethrough, the vacuum chamber having a first end adjacent to the guiding surface and a second end opposite the first end, the vacuum chamber having a curved section between the first and second end;

c) at least one air nozzle disposed in spaced apart relation to the air intake orifice such that a stream of air is directed from the nozzle toward the orifice; and d) an underlay surface extending beneath at least a portion of the lower surface.

8. The sewing machine attachment of claim 2, wherein the vacuum chamber induces a flow of air having a flow rate at least as great as the flow rate of the stream of air from the air nozzle.

9. An apparatus for folding an edge of a piece of material underneath the material to form a hem, comprising:

a) a support plate having an upper surface and a lower surface, the upper surface and lower surface merging along an elongated front edge;

b) a vacuum chamber mounted beneath the lower surface and having a guiding surface with at least one air intake orifice therethrough such that the guiding surface provides an abutment preventing the raw edge of the material from being drawn into the vacuum chamber, the guiding surface defines a wall of the vacuum chamber, the guiding surface extends along only a portion of the piece of material, and the vacuum chamber induces the edge of the material to the guiding surface;

c) at least one air nozzle disposed in spaced apart relation to the air intake orifice such that a stream of air is directed from the nozzle toward the orifice such that the stream of air induces the edge of the material into alignment and abutment with the guiding surface; and d) an underlay surface extending beneath at least a portion of the lower surface such that the edge of the material is guided toward the vacuum chamber after it is folded over the front edge.

10. The apparatus of claim 9, wherein the support plate is adjustably mounted above the vacuum chamber such that the distance between the guiding surface and the front edge is variable, while allowing unimpeded access of the edge of the material to the guiding surface.

11. The apparatus of claim 10, further comprising an elongated member extending from and substantially in alignment with the front edge of the support plate.

12. The apparatus of claim 9, further comprising an elongated member extending from and substantially in alignment with the front edge of the support plate.

13. The apparatus of claim 9, wherein an edge of the underlay surface extends away from the guiding surface along a curved path.

14. An apparatus for folding an edge of a piece of material underneath the material to form a hem, comprising:

a) a support plate having an upper surface and a lower surface, the upper surface and lower surface merging along an elongated front edge;

b) a vacuum chamber mounted beneath the lower surface and having a guiding surface with at least one air intake orifice therethrough such that the vacuum chamber induces the edge of the material to the guiding surface, the vacuum chamber having a first end adjacent to the guiding surface and a second end opposite the first end, the vacuum chamber having a curved section between the first and second end;

c) at least one air nozzle disposed in spaced apart relation to the air intake orifice such that a stream of air is directed from the nozzle toward the orifice; and d) an underlay surface extending beneath at least a portion of the lower surface such that the edge of the material is guided toward the vacuum chamber after it is folded over the front edge.

15. A sewing machine attachment for folding the edge of a piece of material, comprising:

a) a support plate having an upper surface and a lower surface, the upper surface and lower surface merging along an elongated front edge;

b) a vacuum chamber mounted beneath the lower surface and having a guiding surface for aligning, abutting and guiding the edge of the piece of material, the guiding surface having at least one air intake orifice therethrough such that the guiding surface defines a wall of the vacuum chamber, and the guiding surface provides an abutment preventing the raw edge of the material from being drawn into the vacuum chamber;

c) means for guiding a stream of air toward the at least one air intake orifice; and d) an underlay surface extending beneath the lower surface and juxtaposed with the guiding surface such that the edge of the material is guided toward the vacuum chamber after it is folded over the front edge.

16. The sewing machine attachment of claim 15, wherein the support plate is adjustably mounted above the vacuum chamber such that the distance between the guiding surface and the front edge is variable, while allowing unimpeded access of the edge of the material to the guiding surface.

17. The sewing machine attachment of claim 16, further comprising an elongated member extending from and substantially in alignment with the front edge of the support plate.

18. The sewing machine attachment of claim 15, further comprising an elongated member extending from and substantially in alignment with the front edge of the support plate.

19. The sewing machine attachment of claim 15, wherein the underlay surface extends away from the guiding surface such that the edge of the material is tucked under the lower surface by the edge of the underlay surface when the material overhangs and travels along the front edge.

20. A sewing machine attachment for folding the edge of a piece of material, comprising:

a) a support plate having an upper surface and a lower surface, the upper surface and lower surface merging along an elongated front edge;

b) a vacuum chamber mounted beneath the lower surface and having a guiding surface for aligning and guiding the edge of the piece of material, the guiding surface having at least one air intake orifice, the vacuum chamber having a first end adjacent to the guiding surface and a second end opposite the first end, the vacuum chamber having a curved section between the first and second end;

c) means for guiding a stream of air toward the at least one air intake orifice; and d) an underlay surface extending beneath the lower surface and juxtaposed with the guiding surface such that the edge of the material is guided toward the vacuum chamber after it is folded over the front edge.

21. An apparatus for folding an edge of a piece of material underneath the material to form a hem for sewing, comprising:

a) a support plate having an upper surface and a lower surface, the upper surface and lower surface merging along an elongated front edge;

b) a vacuum chamber mounted beneath the lower surface and having a guiding surface with four intake orifices therethrough such that the vacuum chamber induces the edge of the material to the guiding surface such that the guiding surface provides an abutment preventing the raw edge of the material from being drawn into the vacuum chamber, the guiding surface defines a wall of the vacuum chamber, the guiding surface extends along only a portion of the piece of material, and the vacuum chamber induces the edge of the material into alignment and abutment with the guiding surface;

c) four air nozzles disposed in spaced apart relation to the air intake orifices such that streams of air are directed from the nozzles toward the orifices such that the streams of air induce the edge of the material into alignment and abutment with the guiding surface; and d) an underlay surface extending beneath and substantially parallel to the lower surface and disposed in spaced apart relation with the guiding surface.

* * * * *